US005315319A

United States Patent [19]

Sato et al.

[11] Patent Number: 5,315,319

[45] Date of Patent: May 24, 1994

[54] THERMAL PLATE-MAKING APPARATUS AND THERMAL HEAD THEREFOR

[75] Inventors: Mitsuo Sato; Yusuke Tanno, both of Miyagi, Japan

[73] Assignee: Ricoh Company, Ltd., Tokyo, Japan

[21] Appl. No.: 863,718

[22] Filed: Apr. 3, 1992

[30] Foreign Application Priority Data

Apr. 4, 1991 [JP] Japan ..... 3-071787
Jun. 19, 1991 [JP] Japan ..... 3-147572

[51] Int. Cl.[5] ..... B41J 2/335
[52] U.S. Cl. ..... 346/76 PH
[58] Field of Search ..... 346/76 PH; 400/180

[56] References Cited

FOREIGN PATENT DOCUMENTS 0012337 2/1978 Japan ..... 346/76 PH
0180853 9/1985 Japan ..... 346/76 PH
0108071 5/1987 Japan ..... 346/76 PH
0067133 3/1990 Japan ..... 346/76 PH

*Primary Examiner*—Benjamin R. Fuller
*Assistant Examiner*—Huan Tran
*Attorney, Agent, or Firm*—Oblon, Spivak, McClelland, Maier & Neustadt

[57] ABSTRACT

A thermal plate-making apparatus has a line thermal head comprising a plurality of heat units aligned on a line. Each of the heat units comprises electrodes and plural heat elements located therebetween. The apparatus effectively prevents back face reprint of image in a stack of printed sheets, stains due to rubbing between the printed sheets, and dotted images, allowing printing of stable image density. Further, a thermal plate-making apparatus has a line thermal head comprising heat units aligned in a first direction, in which each of the heat units comprises a pair of electrodes opposed in a second direction perpendicular to the first direction and a heat element positioned between the electrodes, and in which the heat element is formed not lower than the electrodes. This apparatus also effectively prevents the back face reprint with the minimum ink transfer amount necessary for printing, providing a loyal print image.

6 Claims, 13 Drawing Sheets

THERMAL PLATE-MAKING APPARATUS AND THERMAL HEAD THEREFOR

BACKGROUND OF THE INVENTION

1. Field of the Invention

The present invention relates to a thermal plate-making apparatus. More particularly, the invention relates to a structure of a thermal head which heats to perforate an original sheet for screen printing.

2. Description of the Related Background Art

In conventional thermal plate-making apparatus, a thermal head has a line of heat units at a predetermined pitch in a primary scan direction. Each of the heat units has a heat element between a pair of electrodes opposing to each other in a secondary scan direction perpendicular to the primary scan direction. The secondary scan direction is a shift direction of a thermal screen original sheet composed of a thermoplastic resin film and a porous support. The heat elements are contacted with the thermoplastic resin film to heat to perforate the thermal screen original sheet.

The size of the heat elements would be limited by an amount of shift of the thermal screen original sheet. For example, supposing dimensions of each heat element are a in the primary scan direction and b in the secondary scan direction, one has a ratio of a to b as 1:2, another has longer b than the pitch between two adjacent heat elements, and other has equal a and b. Using such thermal heads with thus formed heat elements, there has been recognized the following problems after perforation of the thermal screen original sheet.

The heat elements are heated while contacting with the thermoplastic resin film to fuse and perforate the film. Such a problem occurs after heating that the fusing thermoplastic resin film is melted too much after the heating of the heat elements due to thermal inertia, causing interconnection of perforations.

Then, when the thus formed thermal screen original sheet is used for screen printing, an excessive amount of ink would be transferred through the interconnected perforations onto a print sheet. The printed sheets with images formed with an excessive amount of ink cause problems when stacked on a sheet tray. One of the problems is back face reprinting, which is reprinting of an image on a printed sheet discharged onto the tray, onto a back face of the next discharged printed sheet. Another problem is rubbing stains caused on a stacked printed sheet which is rubbed by the following printed sheet.

Japanese Unexamined Patent Publication Hei 2-67133 describes a thermal plate-making apparatus preventing the interconnection of perforations by shortening the length b of heat elements in the secondary scan direction as being smaller than the pitch of heat elements to reduce a contact area between the heat elements and thermoplastic resin film, to solve such problems.

In the above arrangement of only one heat element between the opposing electrodes, a smaller diameter of perforation may reduce an amount of ink passed therethrough to prevent the back face reprinting or the rubbing stains to some extent. However, too small perforations result in enlargement of spacing between neighbouring perforations, which in turn causes a dotted image when printed. The dotted image might lack an image density required.

Furthermore, the thermal head as disclosed in the above-mentioned Japanese Unexamined Patent Publication Hei 2-67133 has rises at respective electrodes due to wiring with a height difference. The rises change a condition of contact of a thermal screen original sheet with a protection layer covering the heat elements and the electrodes, so that ununiform perforations would be formed on the original sheet.

In detail, the thermal screen original sheet is composed of the thermoplastic film contacting the surface of the thermal head and the porous support supporting the back of the film. The porous support includes numerous fibers therein.

When the thermoplastic film is brought into contact with the thermal head to form the ink passing perforations, one of the heat elements might be located by chance at a position where there is no fibers in the porous support. In such occasion, there would be caused a spacing between the thermoplastic film and the protection layer of the thermal head, separating them from each other even upon pressing by a platen roller. This causes unstable heat transfer from the thermal head, which results in reduction of perforation size or no formation of perforation.

SUMMARY OF THE INVENTION

It is the first object of the present invention to provide a thermal plate-making apparatus and a thermal head therefor, which may minimize an amount of ink transferred onto a print sheet upon screen printing and which may prevent back face reprinting and rubbing stains upon stacking of printed sheets.

This object can be achieved by a thermal plate-making apparatus comprising a line thermal head in which a plurality of heat units are aligned at a predetermined pitch on a line in a primary scan direction and a pair of electrodes are disposed at opposed ends of each heat unit in a secondary scan direction: wherein contacted with the line thermal head is a thermal screen original sheet composed of a thermoplastic resin film and a support; the thermal screen original sheet is moved relative to the line thermal head to form perforations of dot in the original sheet by heat of the heat units; and each of said heat units disposed between said respective paired electrodes comprises a plurality of heat elements.

The above object can also be achieved by a line thermal head comprising heat units aligned on a line, in which each of the heat units comprises electrodes and a plurality of heat elements arranged therebetween.

In the above apparatus and line thermal head, there are a plurality of heat elements formed between a pair of electrodes. Supposing pitches between the paired electrodes and between two adjacent heat units are equal to those in the conventional thermal head, perforations formed by each heat unit on a thermal screen original sheet include plural dots instead of a dot in the conventional methods, and each of the dots has a smaller opening.

This arrangement reduces the amount of ink transferred onto a print sheet upon screen printing and prevents the back face reprinting and the rubbing stains.

A plurality of small perforations per heat unit instead of a large perforation in the conventional methods, define a narrowed spacing therebetween, avoiding a dotted image upon printing of solid image and providing a necessary image density. Then sharpness of the image may be improved thereby.

It is the second object of the present invention to provide a thermal plate-making apparatus and a thermal head, which may form uniform ink passing perforations, minimizing an amount of ink transferred onto a print sheet, preventing back face reprinting, and providing a high quality print image loyal to an original image.

The second object can be achieved by a thermal plate-making apparatus comprising a line thermal head in which a plurality of heat units are aligned at a predetermined pitch on a line in a primary scan direction and a pair of electrodes are disposed at opposed ends of each heat unit in a secondary scan direction: wherein, contacted with the line thermal head is a thermal screen original sheet composed of a thermoplastic resin film and a porous support; the thermal screen original sheet is moved relative to the line thermal head in a secondary scan direction to form dot perforations in the original sheet by heat of the heat units; the line thermal head has a protrusion under each of the heat units; and a heating layer and a protection layer are successively layered on each protrusion.

The second object can be also achieved by a line thermal head comprising heat units aligned in a first direction, in which each of the heat units comprises a pair of electrodes opposed in a second direction perpendicular to the first direction and a heat unit positioned between the electrodes, and in which the heat unit is formed not lower than the electrodes.

In the above apparatus and line thermal head, a protrusion is formed under a heat unit to rise the heat unit, setting the upper face of the heat unit at an almost identical height to the electrodes. This arrangement allows the heat unit to uniformly contact with the thermal screen original sheet. Consequently, dots of perforations are formed in a uniform manner, solving the problems of ununiformly dotted perforations and of lacking of perforations in case of formation of successive ink passing perforations. Interconnection of ink perforations may be avoided so as to provide dots of uniform size.

In an aspect of the present invention, a length of a protrusion in the secondary scan direction is shorter than the dot pitch of the two adjacent heat units in the primary scan direction.

In a further aspect of the present invention, a width of the protrusion in the primary scan direction is not more than the width of each heat unit in the primary scan direction.

In a still further aspect of the present invention, the protrusion has a height between a height of the electrodes and the electrode height plus 2 μm.

According to such aspects of the present invention, the interconnection of perforations may be effectively prevented upon formation of successive dots.

Further objects and advantages of the present invention will be apparent from the following description of the preferred embodiments of the invention as illustrated in the accompanying drawings.

DESCRIPTION OF THE PREFERRED EMBODIMENTS

Figure 1:
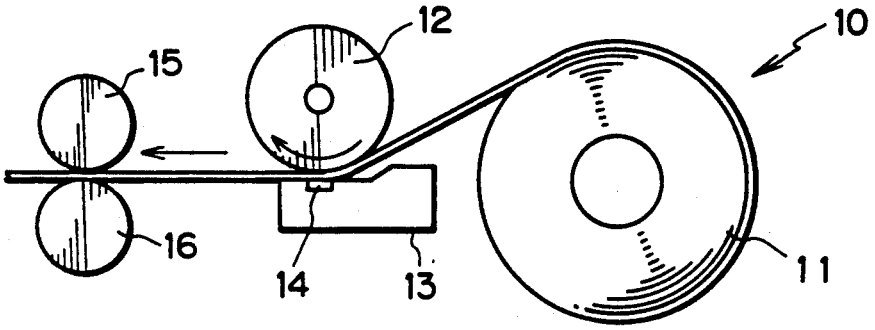
FIG. 1 is a drawing to show a structure of a first embodiment of a thermal plate-making apparatus according to the present invention.
Figure 2:
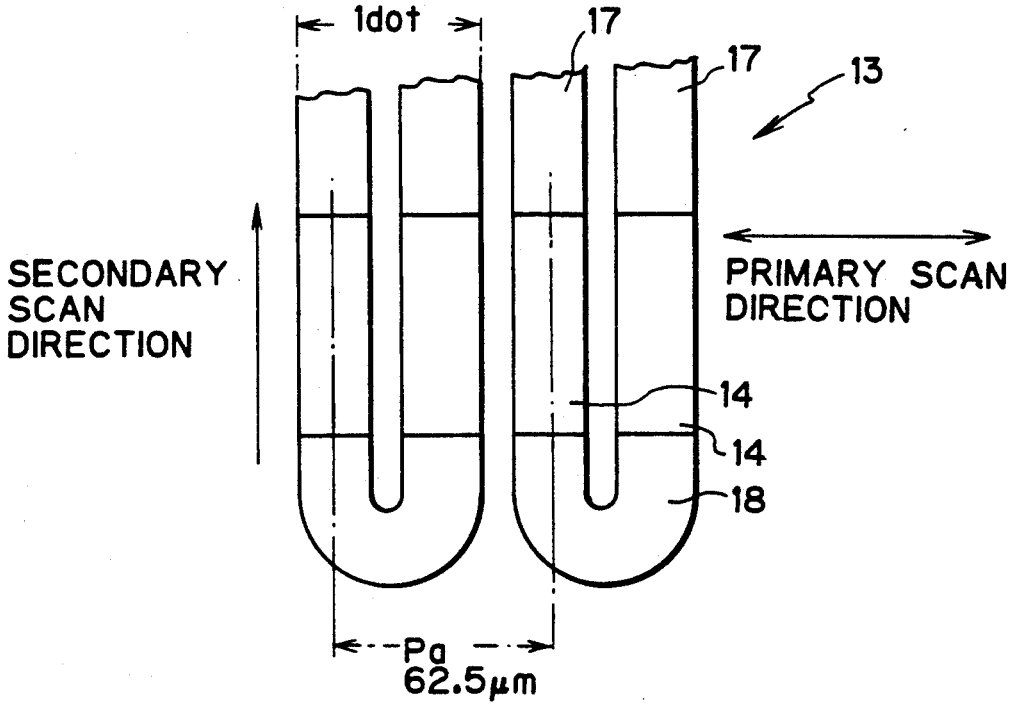
FIG. 2 is a plan view of a line thermal head used in the thermal plate-making apparatus as shown in FIG. 1.
Figure 3:
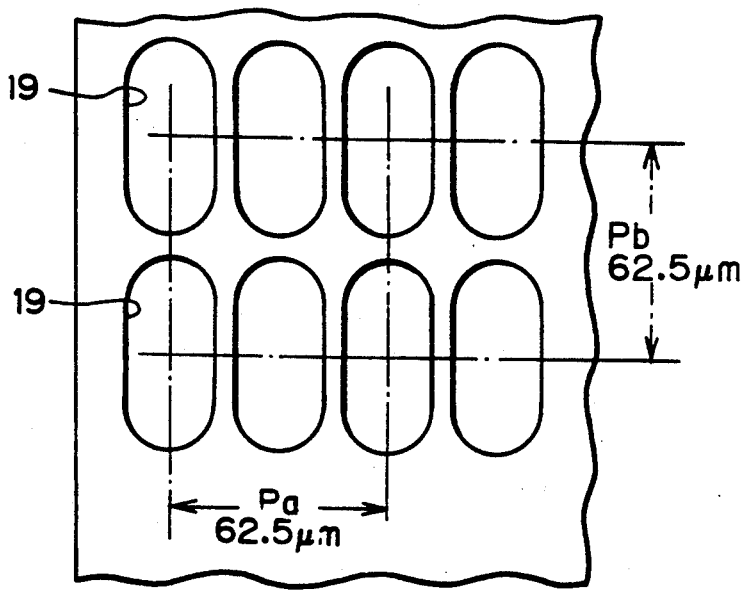
FIG. 3 is a plan view to show perforations on a thermal screen original sheet by the thermal plate-making apparatus as shown in FIG. 1.

First explained with reference to FIGS. 1-3 is the first embodiment of a thermal plate-making apparatus according to the present invention.

In FIG. 1, reference numeral 10 represents a thermal plate-making apparatus, in which a roll of a thermal screen original sheet 11 is rotatably supported, the original sheet 11 passes through between a platen roller 12 and a line thermal head 13, and perforation plate-making is effected on the original sheet 11 by heat of heat elements 11 formed on the line thermal head 13. The perforated original sheet 11 is intermittently shifted through between guide rollers 15, 16 at a predetermined pitch. In case that the line thermal head 13 has 16 dots/mm, the predetermined pitch Pa is 62.5 μm. Then, the thermal screen original sheet 11 is shifted by a pitch Pb of 62.5 μm in a shift direction or in a secondary scan direction.

As shown in FIG. 2, the thermal head 13 has electrodes 17 and intermediate electrodes 18 of U-shape formed in parallel in a primary scan direction or from left to right in the drawing. Heat elements 14 are disposed between the electrodes 17, 18 at a determined spacing.

A heat unit is formed by opposing electrodes 17, 18 and two heating elements 14.

Each heat unit has the two-sectioned electrode 17. A pitch Pa between two successive heat units in the primary scan direction is 62.5 μm. Further, the heat unit includes the two heat elements 14 for the respective sections of the electrode 17, which are connected to the electrode 17 at one end and to the intermediate electrode 18 at the other end. The respective heat elements 14 have a peak of heat temperature at the center thereof, decreasing the heat temperature towards their ends.

In the above arrangement, when electricity is supplied to the electrode 17, the two heat elements 14 in a heat unit almost simultaneously heat to form perforations 19 in the thermal screen original sheet 11 at the pitch Pa of 62.5 μm as shown in FIG. 3. After formation of perforations of first row, the thermal screen original sheet 11 is shifted by the pitch Pb of 62.5 μm in the secondary scan direction. Then, the second row of perforations 19 will be formed similarly as in the first row. The thus formed perforations 19 are smaller in the primary scan direction than those made by the conventional apparatus.

Figure 6:
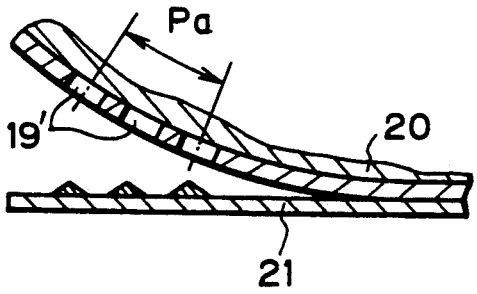
FIG. 6 is a sectional side view to show a condition of ink passed through the perforations as shown in FIG. 5.

If the thus perforated original sheet 11 is used for printing as clamped on a plate cylinder of screen printing apparatus, as shown in FIG. 6, ink 20 inside the plate cylinder passes through the perforations 19' perforated in the thermal screen original sheet 11 to be transferred onto a surface of print sheet 21, forming an image thereon.

The second embodiment will be explained with reference to FIG. 4. In the second embodiment, an unsectioned electrode 17 is formed at one side of heat elements and the other electrode 17', instead of the intermediate electrode 18 in the first embodiment, at the other side in each heat unit. There are four small heat elements 14*a*–14*d* between the electrodes 17, 17' as shown in FIG. 4.

Figure 4:
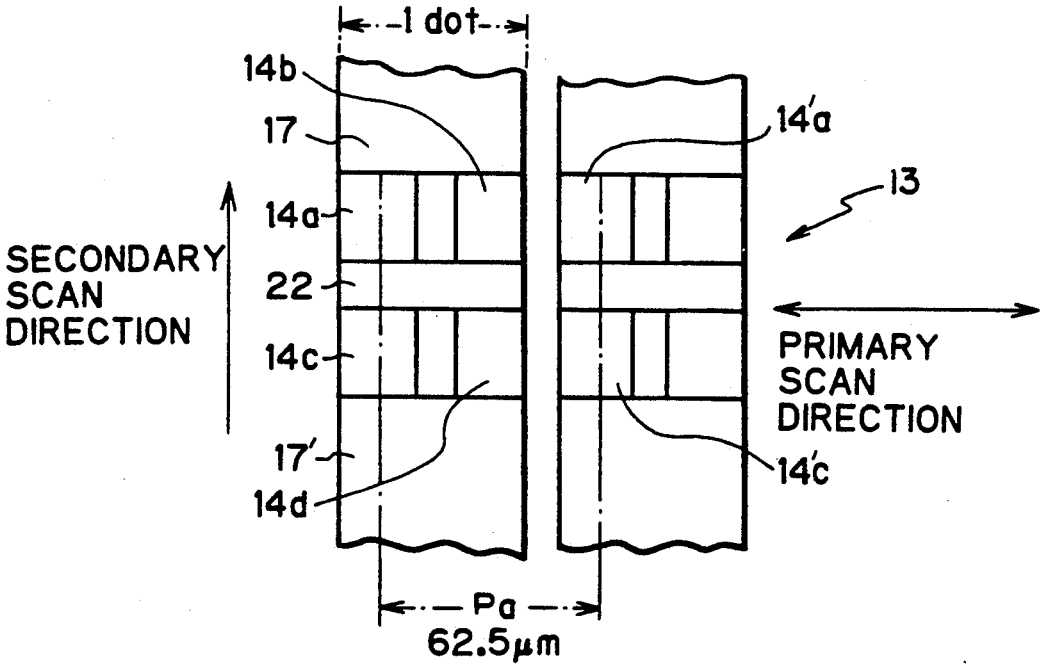
FIG. 4 is a plan view of a line thermal head to show a second embodiment according to the present invention.

In FIG. 4, an intermediate electrode 22 is provided between the electrodes 17 and 17' to divide the area between the electrodes 17, 17' into two. A pair of the heat elements 14*a*, 14*b* are located between the electrode 17 and the intermediate electrode 22 with a spacing therebetween, and another pair of heat elements 14*c*, 14*d* between the electrode 17' and the intermediate electrode 22 also with a spacing therebetween.

A pitch Pa between two successive heat units is 62.5 μm, which is a distance between the heat elements 14*a*, 14*c* and heat elements 14'*a*, 14'*c* of the next adjacent heat unit, respectively.

Figure 5:
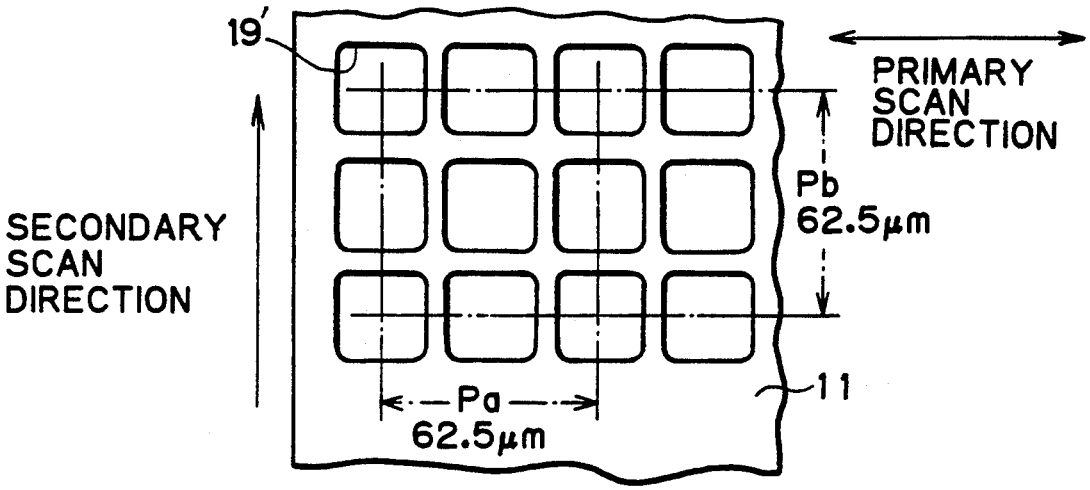
FIG. 5 is a plan view to show perforations on a thermal screen original sheet by the thermal head as shown in FIG. 4.

When electricity is supplied to the electrode 17, the four heat elements 14*a*, 14*b*, 14*c*, 14*d* simultaneously heat in a heat unit, forming four perforations per heat unit. As shown in FIG. 5, there are formed perforations 19' at the pitch Pa of 62.5 μm in the primary scan direction and at the pitch Pb of 62.5 μm in the secondary scan direction with the shift of the original sheet 11.

Since the thermal head of the second embodiment has the increased number of perforations 19' per heat unit as compared to those in the first embodiment, a diameter of each perforation 19' is smaller than that 19 in the first embodiment.

Figure 7:
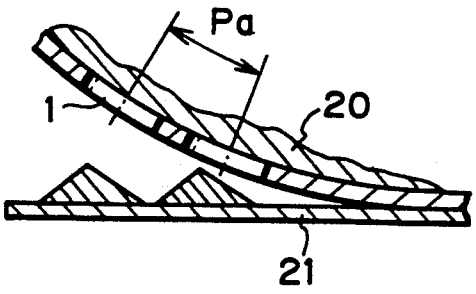
FIG. 7 is a sectional side view to show a condition of ink passed through perforations made by a conventional thermal head.
Figure 8:
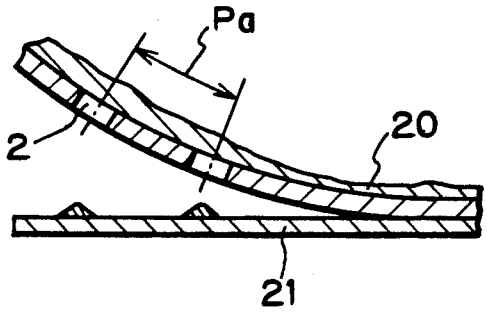
FIG. 8 is a sectional side view to show a condition of ink passed through perforations made by another conventional thermal head.

There will be explained with reference to FIGS. 6 to 9 a relationship between an amount of ink transferred onto a print sheet 21 and an image density of the printed matter by the ink 21. FIGS. 6–8 show differences of transfer of ink 20 due to differences of perforations. FIG. 6 shows a condition of ink transferred through the perforations 19' of the second embodiment, and FIGS. 7 and 8 conditions of ink transferred through perforations 1, 2 by the conventional apparatus as references. It is clear from comparison between FIGS. 6 and 7 that the ink transfer amount through the perforations 19' is less than those 1 in FIG. 7. Although the perforations 2 formed for example by the apparatus as described in the aforementioned Japanese Unexamined Patent Publication Hei 2-67133 let less ink pass, the image quality is unsatisfactory with a dotted image as shown in FIG. 8.

Figure 9:
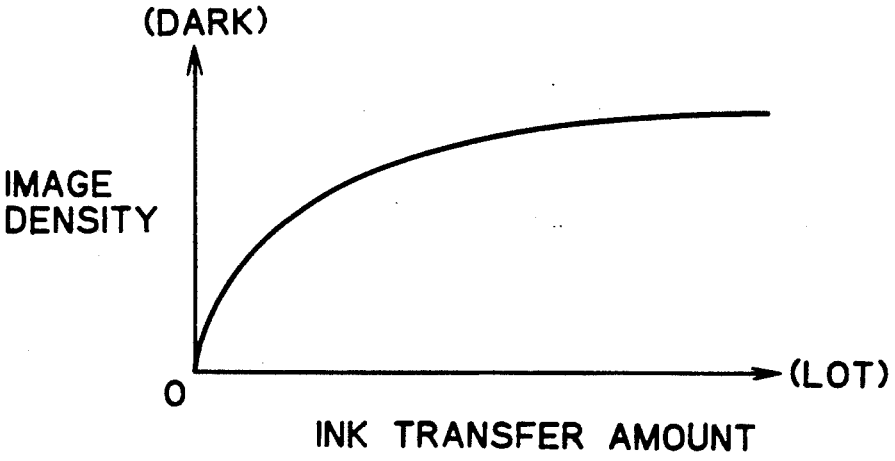
FIG. 9 is a drawing to show a relation between an image density and an ink transfer amount through perforations.

In FIG. 9, the axis of abscissa represents an amount of transferred ink, and the axis of ordinate a density of image. It is seen from FIG. 9, that the image density saturates at a certain amount of transferred ink and does not increase over the certain amount of ink transfer. This means that even if an extreme amount of ink is transferred, not all of it contributes to an increase in the image density and ink over the certain level becomes an excess. Also, it is easy to control an amount of ink by smaller perforations 19' because of the smaller amount of ink passed therethrough rather than by larger perforations 1 as shown in FIG. 7.

The above embodiments show the thermal plate-making apparatus and the line thermal head therefor which may prevent the back face reprinting and the rubbing stains with an optimum amount of transferred ink.

Next explained are preferred embodiments of a thermal plate-making apparatus and a thermal head therefor which may prevent the back face reprinting with the minimum amount of transfer ink and which may provide a high quality print image loyal to an original image, comparing with the conventional apparatus.

First explained are a conventional thermal plate-making apparatus and a line thermal head therefor with reference to FIGS. 19–26.

Figure 19:
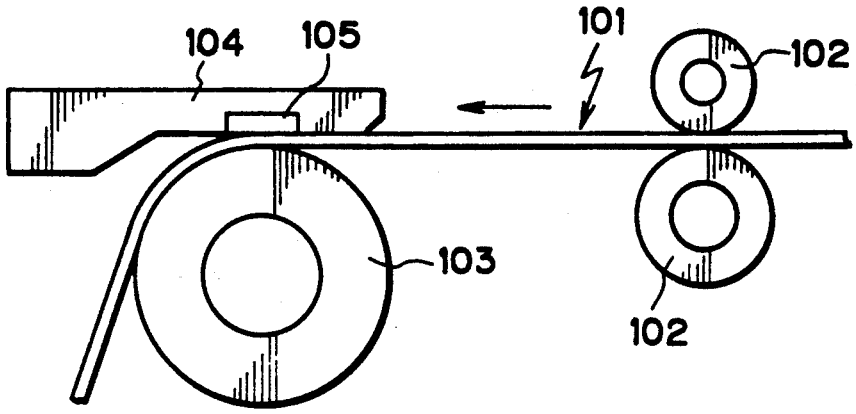
FIG. 19 is a schematic view to show an example of the thermal plate-making apparatus.

FIG. 19 shows an example of the thermal plate-making apparatus. In FIG. 19, a thermal screen original sheet 101 composed of a thermoplastic resin film and a porous support is transferred in the direction of the arrow as shown while pinched by carry rollers 102, and then brought into between a platen roller 103 and a line thermal head 104. The thermal screen original sheet 101 is perforated between the platen roller 103 and the line thermal head 104 by heating the thermoplastic resin facing the thermal head 104.

Figure 20:
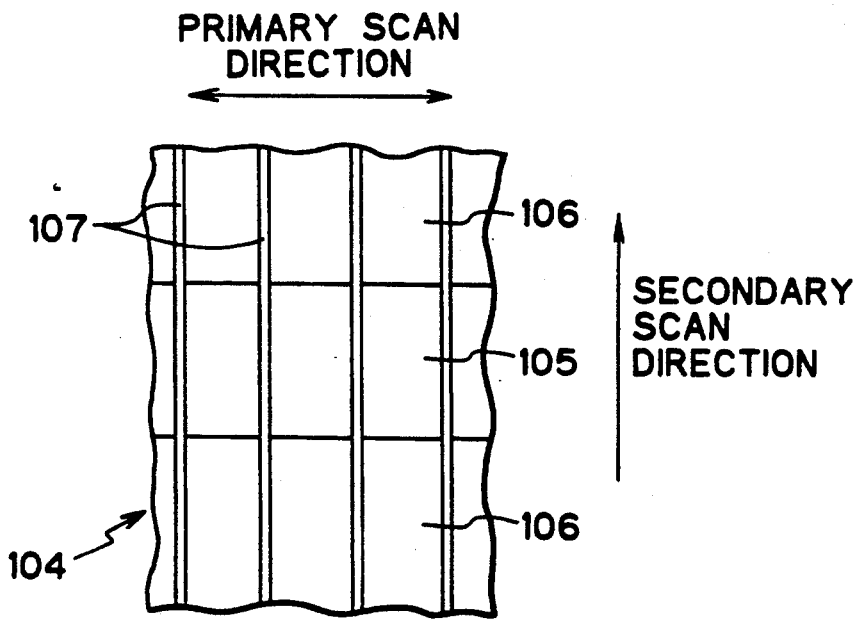
FIG. 20 is a plan view to show an example of conventional line thermal head used in the thermal plate making apparatus as shown in FIG. 19.

FIG. 20 shows an example of structure of the line thermal head 104 in the conventional apparatus. In FIG. 20, the vertical direction is a secondary scan direction parallel to a shift direction of the line thermal screen original sheet 101, and the horizontal direction is a primary scan direction perpendicular to the secondary scan direction. The thermal head 104 has a line of rectangular heat elements 105 aligned and sectioned in the primary scan direction. Electrodes 106 are disposed at either side of the heat elements 105 in the secondary scan direction, and spacings 107 separating the heat elements 105 are provided therebetween to make the respective heat units independent of each other in the primary scan direction.

In the above line thermal head 104, if the resolution of the apparatus is set as 16 dpm, the length of each heat element 105 in the secondary scan direction is about 80–120 μm, the width in the primary scan direction 40–55 μm, and the pitch of the heat elements 62.5 μm in the primary scan direction.

Figure 21:
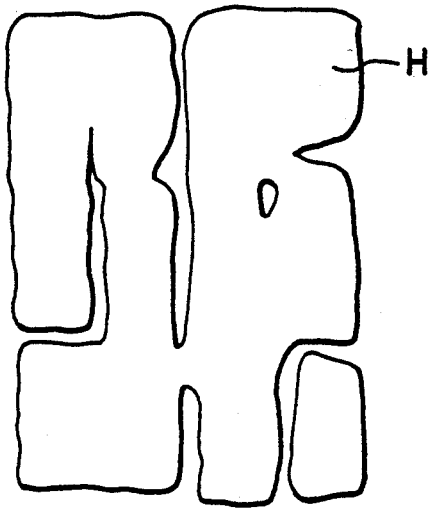
FIG. 21 is a plan view to show perforations on a thermal screen original sheet made by the line thermal head as shown in FIG. 20.

Such a line thermal head is one used in well-known thermal printers. Using such a line thermal head for plate-making of a thermal screen original sheet, a shift pitch of original sheet in the secondary scan direction will be set to the alignment pitch in the primary scan direction, i.e. 62.5 μm. Then the original sheet after plate-making might have interconnection of perforations H is a region of successive dots to form continuous perforations as shown in FIG. 21.

If such interconnected perforations are formed, an excessive amount of ink would be transferred through the connected perforations. This might cause a phenomenon of back face reprinting. That is, the excessive ink on a printed sheet is transferred onto the back face of the following sheet when the printed sheets are stacked on a tray, which is unpreferable for printing.

Figure 22:
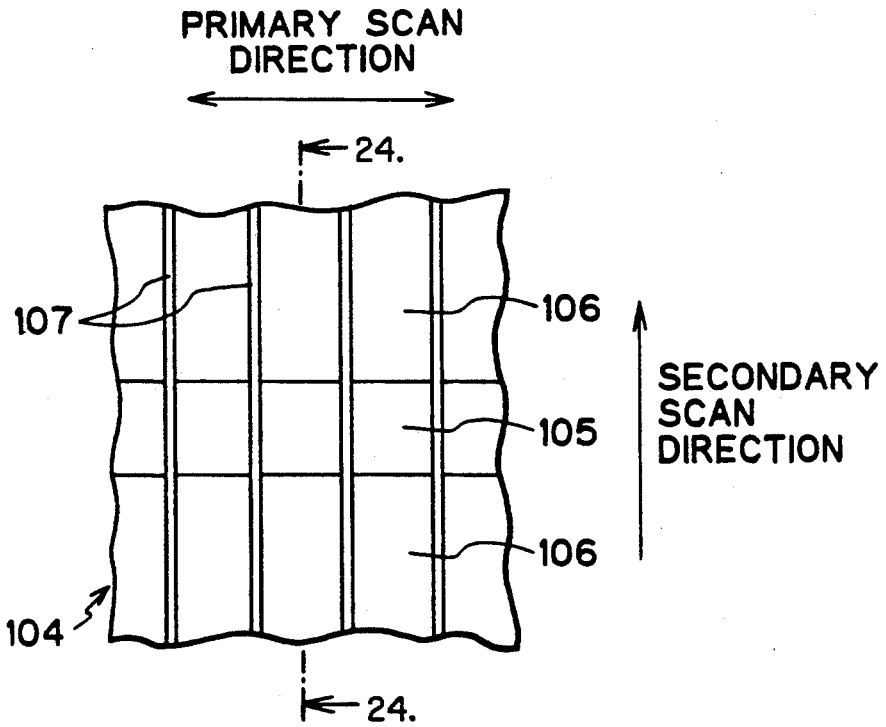
FIG. 22 is a plan view to show another example of line thermal head.
Figure 23:
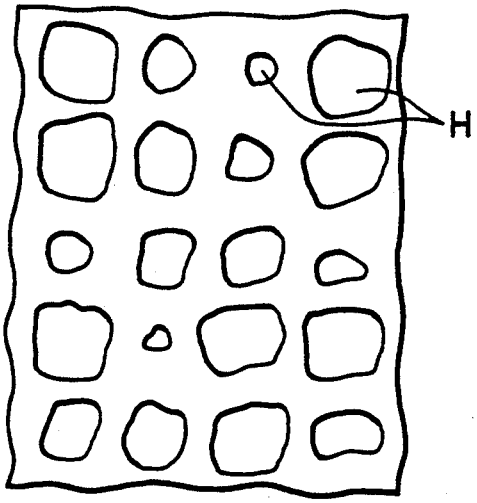
FIG. 23 is a plan view to show perforations on a thermal screen original sheet made by the line thermal head as shown in FIG. 22.

In order to prevent the phenomenon, the line thermal head, as shown in FIG. 22, has heat elements wherein the length thereof in the secondary scan direction is shorter than the alignment pitch thereof in the primary scan direction respectively. As an example of the alignment pitch in the primary scan direction is 62.5 μm as above, the length of the heat elements in the secondary scan direction may be set as about 60 μm. The thermal head as constructed above provides an original sheet after plate-making as shown in FIG. 23, with independent perforations H at a determined pitch as separated from each other. An example of such thermal head is described in Japanese Unexamined Patent Publication Hei 2-67133.

Figure 24:
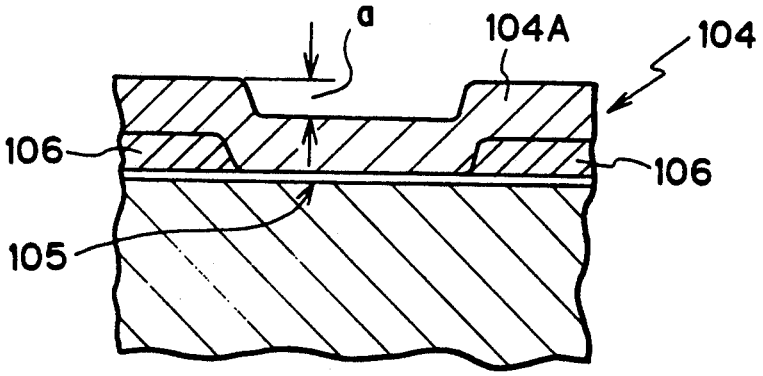
FIG. 24 is a sectional view taken in the direction of the arrows along the line A—A of FIG. 22.

However, as shown in FIG. 24, the line thermal head 104 of such a structure has rises at respective electrodes 106 due to wiring with a height difference a, so that uniform ink passing perforations may not be formed due to a structure of thermal screen original sheet 101 contacting with a protection layer 104A covering heat elements 105 and electrodes 106.

In detail, the thermal screen original sheet 101, as explained before, is composed of a thermoplastic film 101A contacting a surface of the line thermal head 104 and a porous support 101B located on the back of the film 101A. The porous support 101B includes numerous fibers 101C therein.

Figure 25:
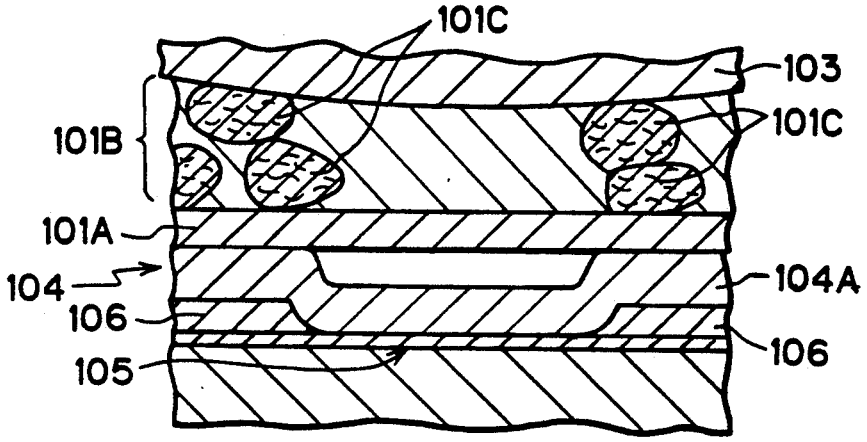
FIG. 25 is a sectional view to illustrate a condition of contact between the original sheet and the line thermal head as shown in FIG. 20 or 22.

When the thermoplastic film 101A is brought into contact with the line thermal head 104 to form ink passing perforations, as shown in FIG. 25, some of the heat elements 105 happen to locate at a position where no fibers 101C is included in the porous support 101B. Then there would be a spacing between the thermoplastic film 101A and the protection layer 104A of the line thermal head 104, so that the thermoplastic film 101A may not contact with the protection layer 104A of the line thermal head 104 through the fibers upon urging by the platen roller 103. As a result, heat transfer from the thermal head 104 would be insufficient to make perforations, resulting in reduction of size of the perforations or no formation of perforations.

Figure 26:
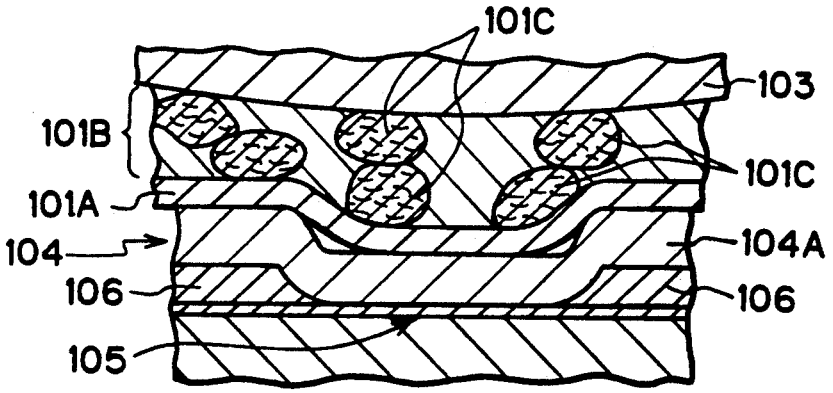
FIG. 26 is a sectional view to illustrate another condition of contact between the original sheet and the line thermal head as shown in FIG. 20 or 22.

On the contrary, FIG. 26 shows a case that the fibers 101C exist at the position where the heat element 105 contacts with the porous support 101B. The fibers 101C may fill the spacing upon urging of the platen roller 103 so that the thermoplastic film may closely contact with the protection layer 104A of the line thermal head 104 through the fibers 101C. In this case, heat will be transferred from the heat element 105 to the thermoplastic film 101A, forming the ink perforation.

Accordingly, contact between the thermoplastic film 101A of thermal screen original sheet 101 and the protection layer 104A of line thermal head 104 differs depending upon the internal structure of the thermal screen original sheet 101, presenting a problem of ununiform formation of ink perforations.

Explained in the following with reference to FIGS. 10–17 is the third embodiment of the thermal plate-making apparatus and the line thermal head therefor according to the present invention, solving the above problems.

Figure 10:
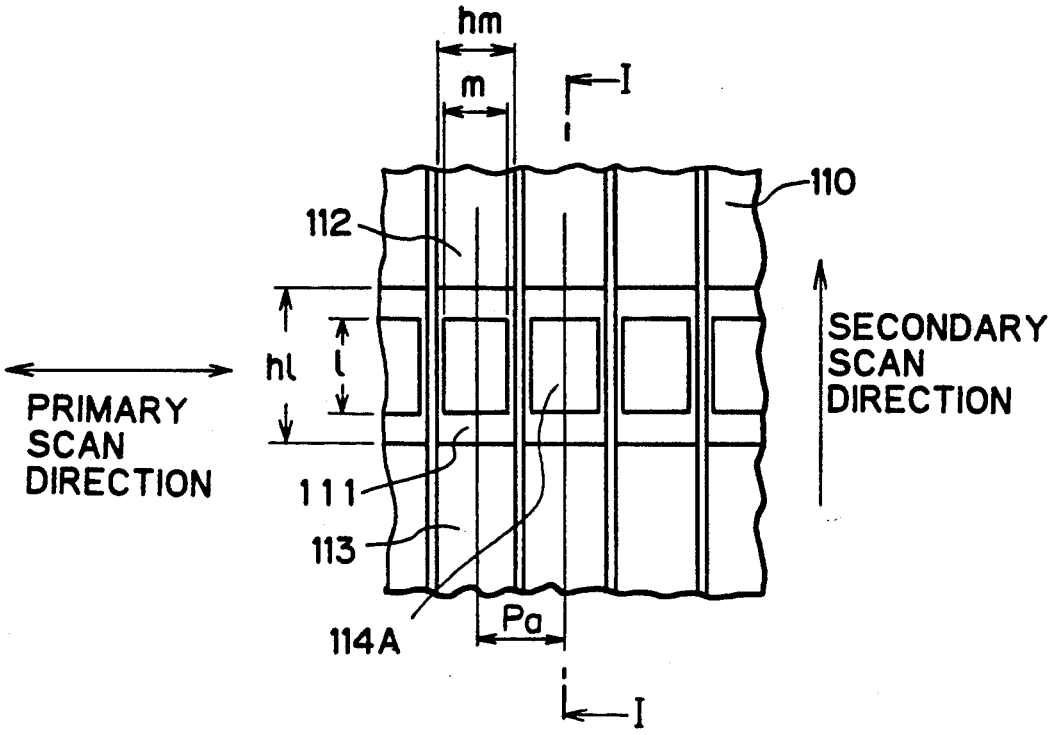
FIG. 10 is a plan view to show a line thermal head for a third embodiment of the thermal plate-making apparatus according to the present invention.

FIG. 10 is a plan view to show a schematic structure of a line thermal head used in the third embodiment of the thermal plate-making apparatus according to the present invention. In FIG. 10, a line thermal head 110 has a plurality of rectangular heat elements 111 sectioned and aligned in the primary scan direction. The heat elements 111 are formed by metallizing or other process on a line in the primary scan direction.

Electrodes 112, 113 for power supply therethrough are provided on either side of the heat elements 111 in the secondary scan direction. The heat elements 111 may be earthed, so that electricity may be supplied through the electrodes 112, 113 to the heat elements 111 to heat them. A heat unit is composed of one heat element 111 and two opposing electrodes 112, 113. A plurality of heat units are aligned on a line in the primary scan direction of the line thermal head 110.

Figure 11:
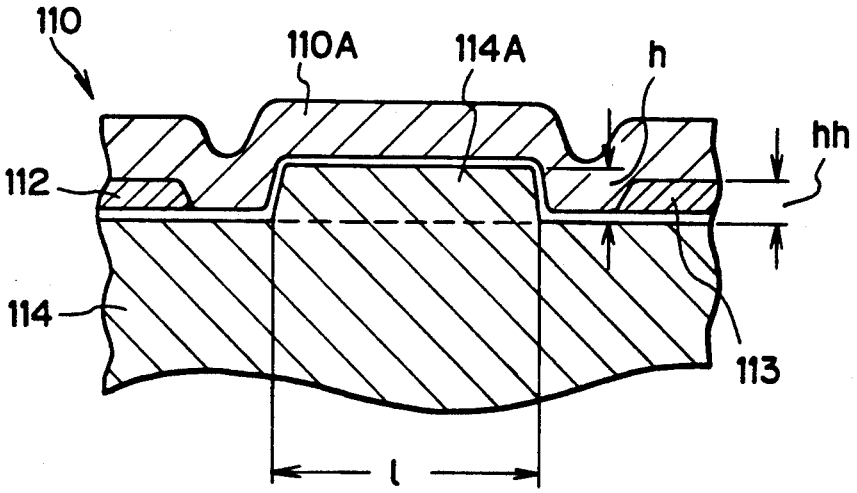
FIG. 11 is a sectional view taken in the direction of the arrows along the line I—I of FIG. 10.

A grace layer 114 is located under the heat element 111 in each heat element of the line thermal head 110. As shown in FIG. 11, the grace layer 114 has a protrusion 114A projecting towards the protection layer 110A within the area of the heat element 111 in each heat unit. A heat layer of heat element 111 and a protection layer 110A are successively layered over the protrusion 114A.

The protrusion 114A may be formed by photolithography following the steps of FIGS. **12*a*–12*e*. In a plan view, the protrusion 114A is rectangular as shown in FIG. 10**.

The protrusion 114A may be formed as follows.

Figure 12A:
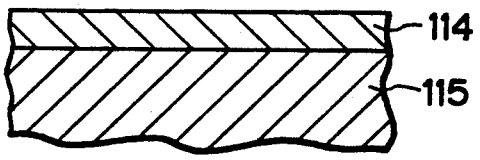
FIG. 12 is a schematic view to illustrate processes to form a protrusion of grace layer in a line thermal head as shown in FIG. 10.
Figure 12B:
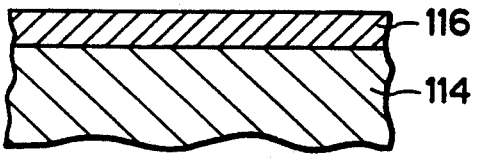
Figure 12C:
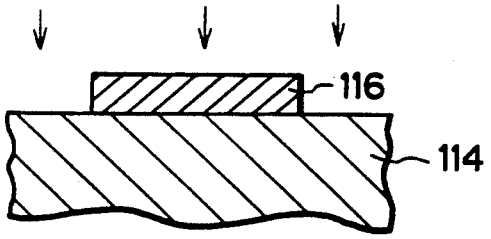
Figure 12D:
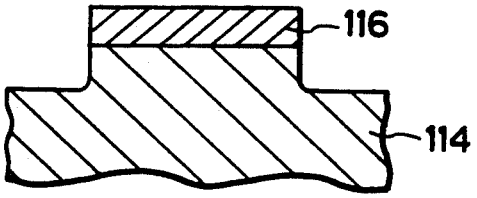
Figure 12E:
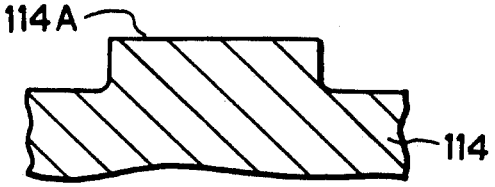

The grace layer 114 is formed on an alumina substrate 115 as shown in FIG. **12*a*. Then a resist layer 116 is coated over a surface of the grace layer 114 as shown in FIG. 12*b*. Ultraviolet light is irradiated on the resist layer 116 excluding a portion corresponding to the protrusion 114A. After the irradiation, the part irradiated by the ultraviolet light is eliminated, leaving the portion of resist layer 116 corresponding to the protrusion 114A as shown in FIG. 12*c*. Then the grace layer 114 is subject to etching with etching agent of hydrogen fluoride of 20% and ammonium fluoride of 50% with a ratio of 1:6, so that the grace layer 114 is etched by the height of the protrusion 114A, leaving the resist layer 116 corresponding to the protrusion 114A as shown in FIG. 12***d*. The remaining resist layer 116 is finally removed from the surface of the protrusion 114A as shown in FIG. 12*e*.

The thus formed protrusion 114A by the photolithography has the following dimensions. In the plan view in FIG. 10, a length 1 in the secondary scan direction is shorter than a length h1 corresponding to a dot or unit pitch Pa, and a width m in the primary scan direction is smaller than the width hm of the heat element 105 in the primary scan direction. Further, the height h of the protrusion 114A is set within a range from the height hh of the electrodes 112, 113 to the height (hh+2 μm) as shown in FIG. 11.

The above dimensions of the protrusion 114A are determined considering a size of perforation formed by the heat element 111 including the protection layer 110A. In other words, the dimensions are set such that the size of perforation formed by the heat element 111 will never exceed the size of the heat element 111.

The protection layer 110A over the protrusion 114A covers the surface of the grace layer 114, having the shorter length in the secondary scan direction than the dot pitch, and the width in the primary scan direction not more than the width of the heat element in the primary scan direction. Further, the protection layer 110A is also protruded at the protrusion 114A, presenting the upper surface equivalent to or over the electrodes 112, 113 in height.

In the above arrangement, the protection layer 110A is projected by the protrusion 114A at the height equivalent to or over the electrodes 112, 113, so that the thermal screen original sheet urged by a platen roller against the protection layer 110A may uniformly contact with the protection layer 110A, allowing uniform heat transmission from the heat element 111 to form ink perforations.

Since the protection layer 110A is projected by the protrusion 114A at the heat element 111 and its size is smaller than the dot pitch, a spacing between the protection layer 110A and the original sheet may be effectively reduced and interconnection of perforations may also be prevented, solving the problems of nonuniformity or no formation of ink perforations as well as of continuous connection of perforations.

We have conducted experiments using the above-described line thermal head, obtaining the following results.

EXPERIMENT 1

Figure 13:
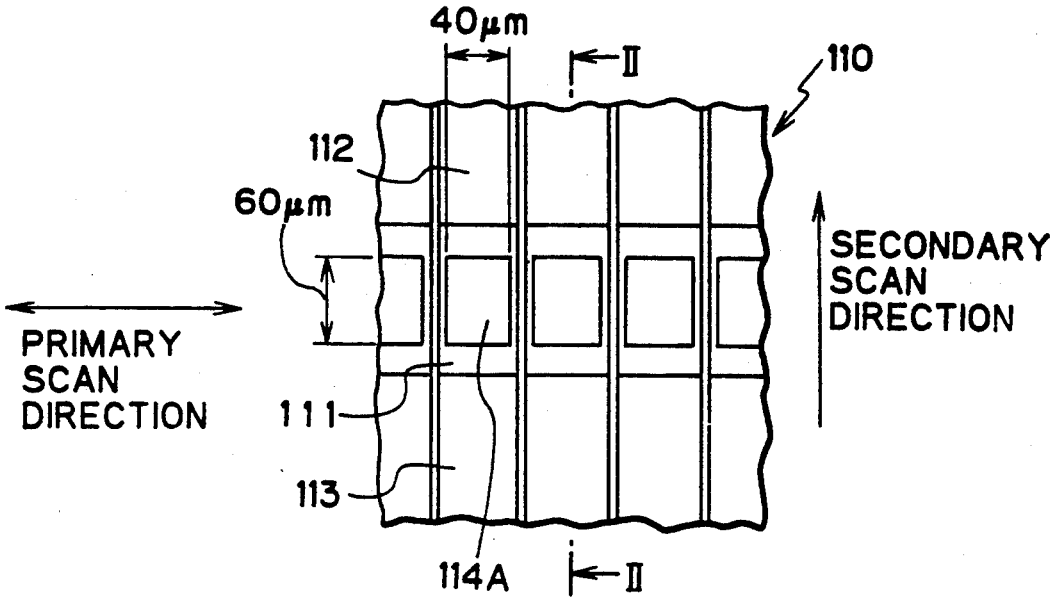
FIG. 13 is a plan view to show dimensions of protrusion for test of the line thermal head as shown in FIG. 10.
Figure 14:
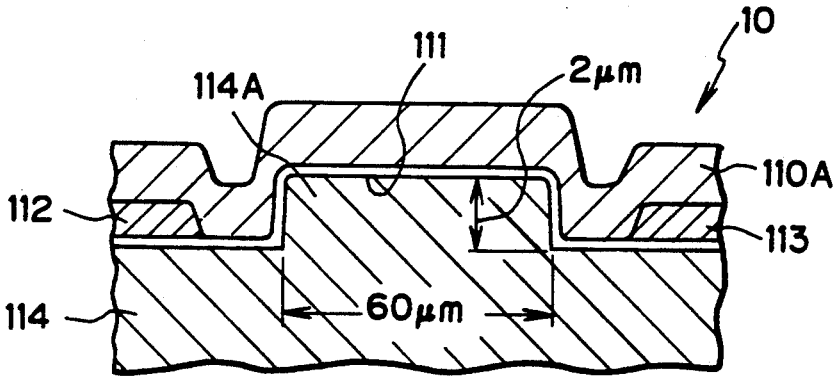
FIG. 14 is a sectional view taken in the direction of the arrows along the line II—II of FIG. 13.

A thin film type thermal head 110 of 16 dpm as shown in FIGS. 13 and 14 was set in a perforation plate digital plate-making apparatus (trade name: PRIPORT SS955 manufactured by RICOH). Screens were made by perforating thermal screen original sheets by the line thermal head from originals of letter image, line image, and solid image. The protrusions 114*a* in FIG. 11 of the grace layer 114 in the line thermal head were formed with the following dimensions:

A length hm of heat element in the primary scan direction=45 μm;

A length hl of heat element in the secondary scan direction=85 μm;

A length m of protrusion 114A in the primary scan direction=45 μm;

A length l of protrusion 114A in the secondary scan direction=60 μm; and

A height h of protrusion 114A=2 μm equivalent to a height of electrodes plus 1 μm.

Figure 15:
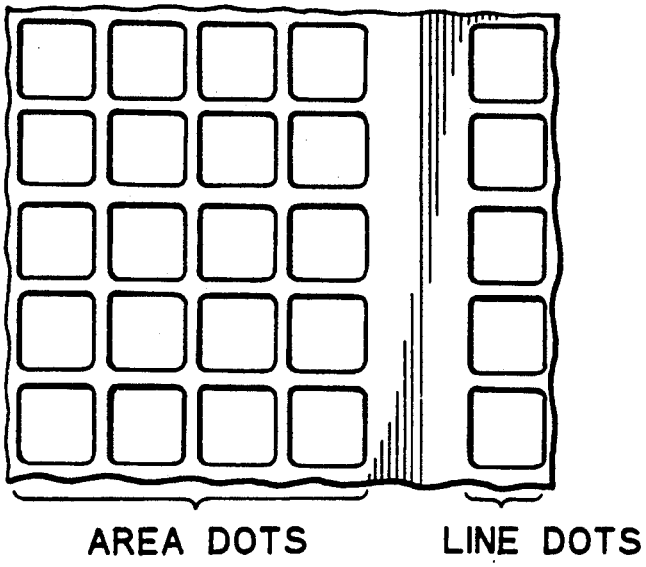
FIG. 15 is a plan view to show perforations on the thermal screen original sheet made by the line thermal head as shown in FIG. 14.

A portion of the thermal screen original sheets prepared under the above conditions was observed by an optical microscope. The results showed dots of uniform size as shown in FIG. 15. Even if dots were successively made over an area, independent perforations were formed without interconnection thereof.

An image printed by the thermal screen original sheet obtained from the above plate-making showed no thin spot as shown in FIG. 15, loyal to an original image. Observing back faces of stacked print sheets after printing plural sheets, there was no back face reprinting found. Experiment results using a conventional line thermal head were obtained as follows for comparison with the above experiment results.

The conventional line thermal head had the same length and width of heat element in the primary and secondary scan directions as the above conditions for the line thermal head according to the present invention, but it was provided with no protrusion 114A on the grace layer 114. A part of the thermal screen original sheet was observed by the optical microscope.

The observation result showed that vertically and horizontally successive dots were formed separately from each other, but that dots were not uniformly formed in size. Also, an image printed using the thermal screen original sheet made by the line thermal head showed thin parts of line, which could not be said as loyal to the original image. Observing back faces of the printed sheets stacked on a tray after printing plural sheets, no back face reprinting was observed.

The shape of protrusion 114A on the grace layer 114 is not limited to a rectangle in a plan view as shown in FIG. 10. Other shapes may be employed for the protrusion in the present invention.

EXPERIMENT 2

Figure 16:
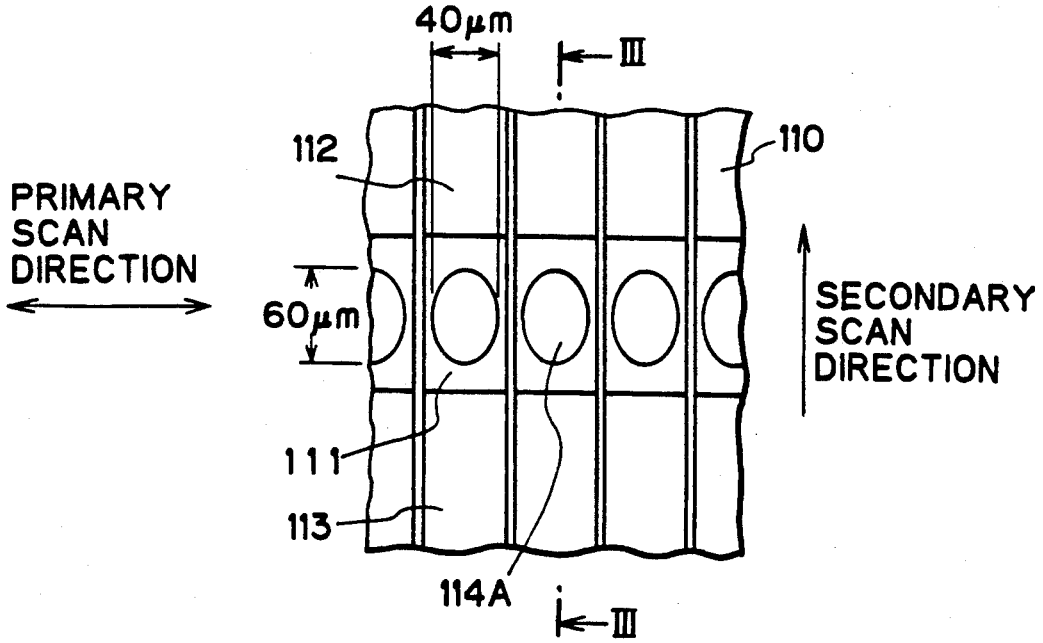
FIG. 16 is a plan view to show a modification of protrusion with another dimensions.
Figure 17:
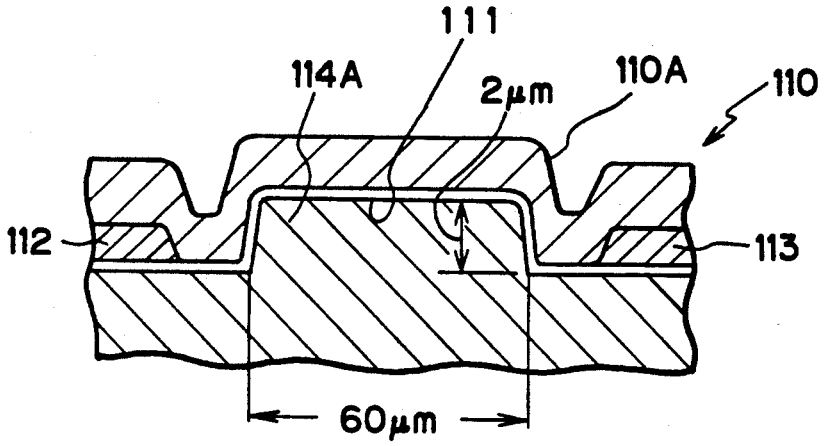
FIG. 17 is a sectional view taken in the direction of the arrows along the line III—III of FIG. 16.

FIGS. 16 and 17 show a thermal head for Experiment 2, in which the shape of heat element is changed from Experiment 1. In Experiment 2, the shape of heat element was set as an oval on a plan view of protrusion 114A on the grace layer 114.

The dimensions of heat element in Experiment 2 were as follows:

A length hm of heat element in the primary scan direction=45 μm;

A length hl of heat element in the secondary scan direction=85 μm;

The oval protrusion 114A on the plan view with the following dimensions;

A length m of protrusion 114A in the primary scan direction=40 μm;

A length l of protrusion 114A in the secondary scan direction=60 μm; and

A height h of protrusion 114A=2 μm equivalent to a height of electrodes plus 1 μm.

Figure 18:
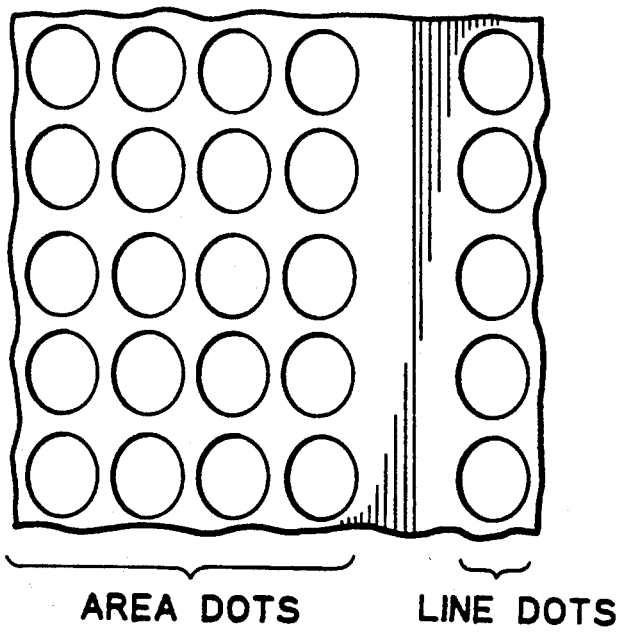
FIG. 18 is a plan view to show perforations on a thermal screen original sheet made by the line thermal head as shown in FIG. 16.

A part of the thermal screen original sheet made by the line thermal head with the grace layer 114 having the above protrusion 114A was observed by the optical microscope. As shown in FIG. 18, the shape of ink passing perforations was different from that in Experiment 1, but was uniform similarly as in Experiment 1. Further, vertically and horizontally successive dots were separately formed from each other without interconnection therebetween.

An image printed by the thermal screen original sheet thus made showed no thin portion on a line, loyal to an original image. Observing back faces of printed sheets stacked on a tray after plural printings, no back face reprinting was found.

As explained above, according to the third embodiment of the present invention, the thermal plate-making apparatus and the line thermal head therefor may be provided without back face reprinting, with the minimum amount of transferred ink, and with a high quality print image loyal to the original image.

Many widely different embodiments of the present invention may be constructed without departing from the spirit and scope of the present invention. It should be understood that the present invention is not limited to the specific embodiments described in the specification, except as defined in the appended claims.

What is claimed is:

1. A thermal plate-making apparatus for forming dot perforations in a thermal screen original sheet composed of a thermoplastic resin film and a porous support, said apparatus comprising a line thermal head having a plurality of heat units in which the plurality of heat units are aligned at a predetermined pitch on a line in a primary scan direction, a pair of electrodes disposed at both opposed ends of each of said heat units in a secondary scan direction, means for contacting the line thermal head and the original sheet and means for relatively moving the original sheet past the line thermal head; wherein, said line thermal head has a grace layer which has a protrusion at a portion thereof corresponding to a lower part of each of said heat units;

a length of said protrusion in the secondary scan direction is shorter than said predetermined pitch of two adjacent heat units of said heat units in the primary scan direction;

a width of said protrusion in the primary scan direction is not more than a width of each of said heat units in the primary scan direction; and each of said heat units comprises a heating layer and a protection layer successively layered on the protrusion.

2. A thermal plate-making apparatus according to claim 1, wherein said protrusion has a height between a height of the electrodes and a height of the electrodes plus 2 μm.

3. A thermal plate-making apparatus according to claim 1, wherein said protrusion is formed by photolithography.

4. A line thermal head comprising a plurality of heat units aligned in a primary scan direction, in which each of said heat units comprises a pair of electrodes opposed in a secondary scan direction perpendicular to said primary scan direction and a heat element positioned between said electrodes; wherein said line thermal head has a grace layer which has a protrusion at a portion thereof corresponding to a lower part of each of said heat units;

a length of said protrusion in the secondary scan direction is shorter than a dot pitch of two adjacent heat units of said heat units in the primary scan direction;

a width of said protrusion in the primary scan direction is not more than a width of each of said heat units in the primary scan direction; and said heat element is formed not lower by said protrusion thereunder than said electrodes.

5. A line thermal head according to claim 4, wherein each of said heat units in covered by a protection layer thereover.

6. A line thermal head according to claim 4, wherein said protrusion is smaller in dimensions than the heat element.

* * * * *